US005644862A

United States Patent [19]

Folmer

[11] Patent Number: 5,644,862

[45] Date of Patent: Jul. 8, 1997

[54] ADJUSTABLE GUN RESTING SYSTEM

[76] Inventor: Neil Folmer, 136 Creek Dr., Slippery Rock, Pa. 16057

[21] Appl. No.: 641,107

[22] Filed: Apr. 29, 1996

[51] Int. Cl.[6] ..... F41A 31/00

[52] U.S. Cl. ..... 42/94

[58] Field of Search ..... 42/94; 89/1.59; 211/64

[56] References Cited

U.S. PATENT DOCUMENTS

| | | | |
|---|---|---|---|
| 2,752,046 | 6/1956 | Levy | 211/4 |
| 4,144,971 | 3/1979 | Balibrea | 211/64 |
| 4,790,096 | 12/1988 | Gibson et al. | 42/94 |
| 4,971,208 | 11/1990 | Reinfried, Jr. et al. | 211/64 |
| 5,060,410 | 10/1991 | Mueller | 42/94 |
| 5,414,949 | 5/1995 | Peebles | 42/94 |
| 5,503,276 | 4/1996 | Pierce | 211/64 |

*Primary Examiner*—Charles T. Jordan
*Assistant Examiner*—Meena Chelliah

[57] ABSTRACT

A new Adjustable Gun Resting System for providing an adjustable compact gun rest which supports a gun while allowing the user to easily adjust the height of the gun to a comfortable shooting position preventing the user from having to bend over during operation of the gun. The inventive device includes a gun resting base, a supporting means secured to the gun resting base, a gun holding means which supports the gun, and an adjusting means allowing a user to adjust the gun holding means for the height of the user.

5 Claims, 3 Drawing Sheets

ADJUSTABLE GUN RESTING SYSTEM

BACKGROUND OF THE INVENTION

1. Field of the Invention

The present invention relates to Gun Rest Devices and more particularly pertains to a new Adjustable Gun Resting System for providing an adjustable compact gun rest which supports a gun while allowing the user to easily adjust the height of the gun to a comfortable shooting position preventing the user from having to bend over during operation of the gun.

2. Description of the Prior Art

The use of Gun Rest Devices is known in the prior art. More specifically, Gun Rest Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Gun Rest Devices include U.S. Pat. No. 5,284,280; U.S. Pat. No. 4,854,066; U.S. Pat. No. 4,012,860; U.S. Pat. No. 5,173,563; U.S. Pat. No. 4,937,965; U.S. Pat. No. 3,576,084 and U.S. Design Pat. No. 324,530.

While these devices fulfill their respective, particular objectives and requirements, the aforementioned patents do not disclose a new Adjustable Gun Resting System. The inventive device includes a gun resting base, a supporting means secured to the gun resting base, a gun holding means which supports the gun, and an adjusting means allowing a user to adjust the gun holding means for the height of the user.

In these respects, the Adjustable Gun Resting System according to the present invention substantially departs from the conventional concepts and designs of the prior art, and in so doing provides an apparatus primarily developed for the purpose of providing an adjustable compact gun rest which supports a gun while allowing the user to easily adjust the height of the gun to a comfortable shooting position preventing the user from having to bend over during operation of the gun.

SUMMARY OF THE INVENTION

In view of the foregoing disadvantages inherent in the known types of Gun Rest Devices now present in the prior art, the present invention provides a new Adjustable Gun Resting System construction wherein the same can be utilized for providing an adjustable compact gun rest which supports a gun while allowing the user to easily adjust the height of the gun to a comfortable shooting position preventing the user from having to bend over during operation of the gun. The general purpose of the present invention, which will be described subsequently in greater detail, is to provide a new Adjustable Gun Resting System apparatus and method which has many of the advantages of the Gun Rest Devices mentioned heretofore and many novel features that result in a new Adjustable Gun Resting System which is not anticipated, rendered obvious, suggested, or even implied by any of the prior art Gun Rest Devices, either alone or in any combination thereof.

To attain this, the present invention generally comprises a gun resting base, a supporting means secured to the gun resting base, a gun holding means which supports the gun, and an adjusting means allowing a user to adjust the gun holding means for the height of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Adjustable Gun Resting System apparatus and method which has many of the advantages of the Gun Rest Devices mentioned heretofore and many novel features that result in a new Adjustable Gun Resting System which is not anticipated, rendered obvious, suggested, or even implied by any of the prior art Gun Rest Devices, either alone or in any combination thereof.

It is another object of the present invention to provide a new Adjustable Gun Resting System which may be easily and efficiently manufactured and marketed.

It is a further object of the present invention to provide a new Adjustable Gun Resting System which is of a durable and reliable construction.

An even further object of the present invention is to provide a new Adjustable Gun Resting System which is susceptible of a low cost of manufacture with regard to both materials and labor, and which accordingly is then susceptible of low prices of sale to the consuming public, thereby making such Adjustable Gun Resting System economically available to the buying public.

Still yet another object of the present invention is to provide a new Adjustable Gun Resting System which provides in the apparatuses and methods of the prior art some of the advantages thereof, while simultaneously overcoming some of the disadvantages normally associated therewith.

Still another object of the present invention is to provide a new Adjustable Gun Resting System for providing an adjustable compact gun rest which supports a gun while allowing the user to easily adjust the height of the gun to a comfortable shooting position preventing the user from having to bend over during operation of the gun.

Yet another object of the present invention is to provide a new Adjustable Gun Resting System which includes a gun resting base, a supporting means secured to the gun resting base, a gun holding means which supports the gun, and an adjusting means allowing a user to adjust the gun holding means for the height of the user.

Even still another object of the present invention is to provide a new Adjustable Gun Resting System wherein the user is able to rest a gun against the present invention in a position comfortable to shoot the gun.

Still another object of the present invention is to provide a new Adjustable Gun Resting System that is easily adjustable to accommodate the height of the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
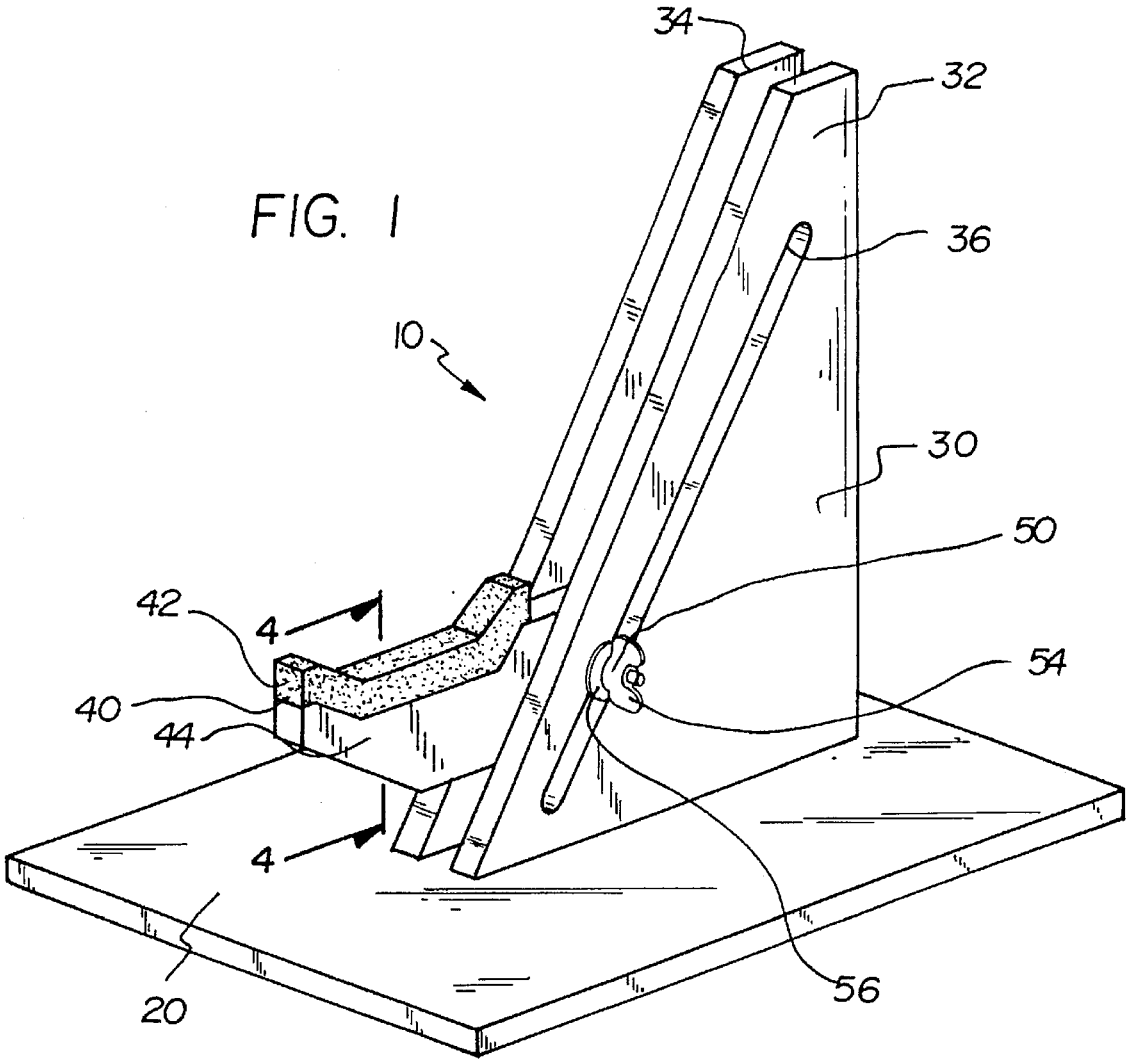
FIG. 1 is an upper right perspective view of a new Adjustable Gun Resting System according to the present invention.
Figure 2:
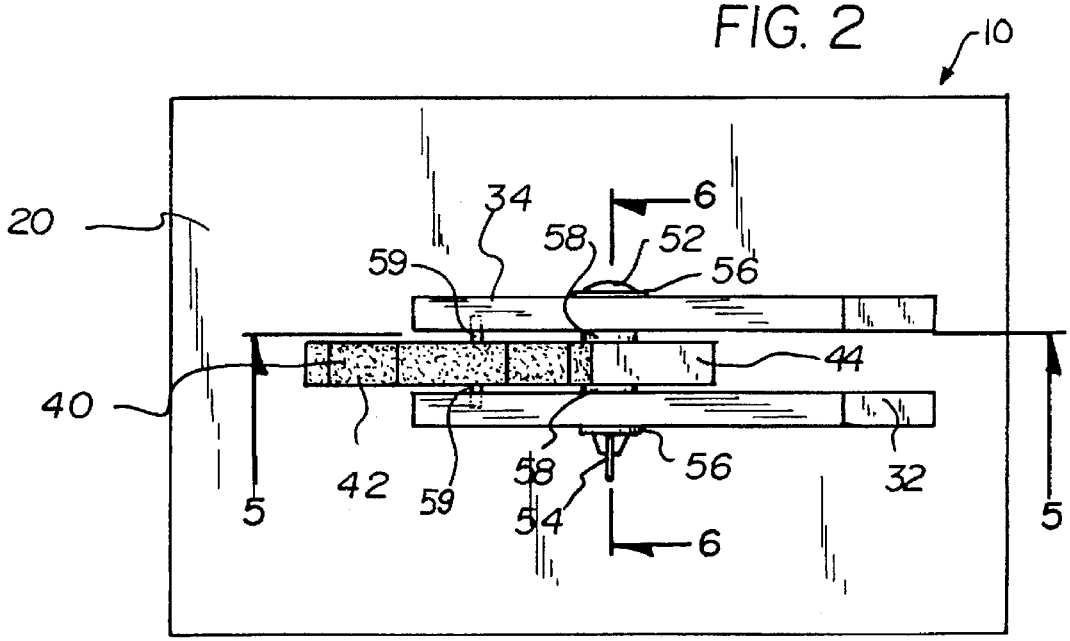
FIG. 2 is a top view thereof.
Figure 3:
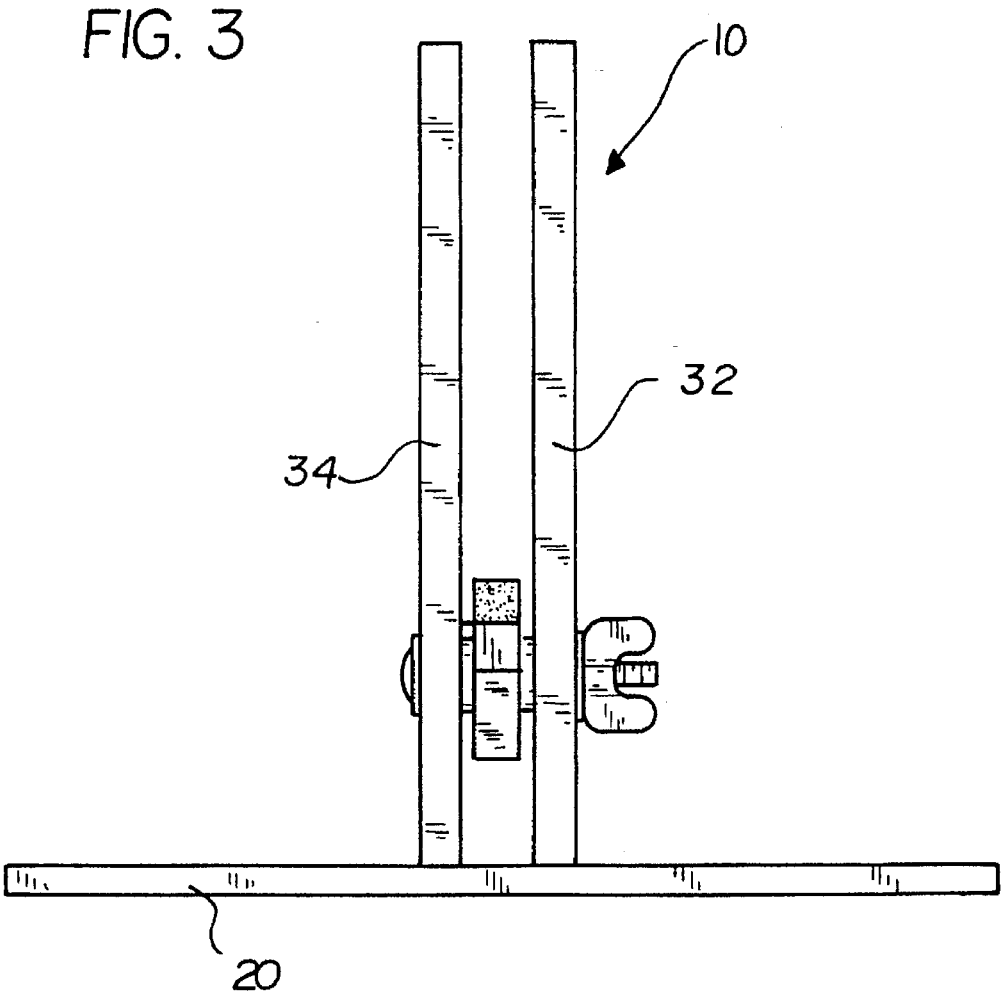
FIG. 3 is a front view of the present invention.
Figure 4:
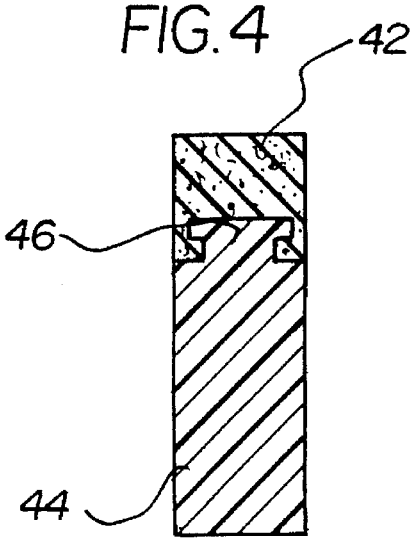
FIG. 4 is a cross sectional view taken along line 4—4 of FIG. 3.
Figure 5:
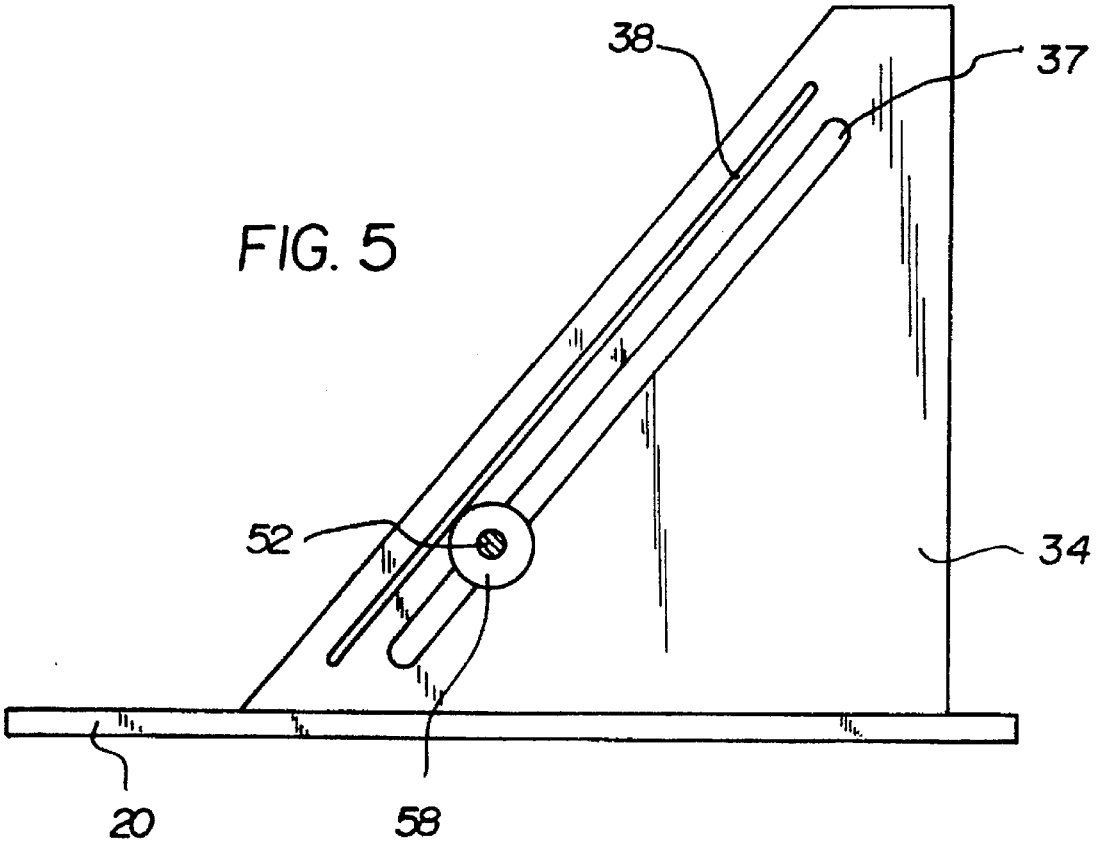
FIG. 5 is a cross sectional view taken along line 5—5 of FIG. 2.

With reference now to the drawings, and in particular to FIGS. 1 through 6 thereof, a new Adjustable Gun Resting System embodying the principles and concepts of the present invention and generally designated by the reference numeral 10 will be described.

More specifically, it will be noted that the Adjustable Gun Resting System 10 comprises a gun resting base 20 for providing stability, a supporting means 30 secured to the gun resting base 20, a gun holding means 40 slidably secured to the supporting means 30 and an adjusting means 50 for adjusting the elevation of the gun holding means 40.

Figure 6:
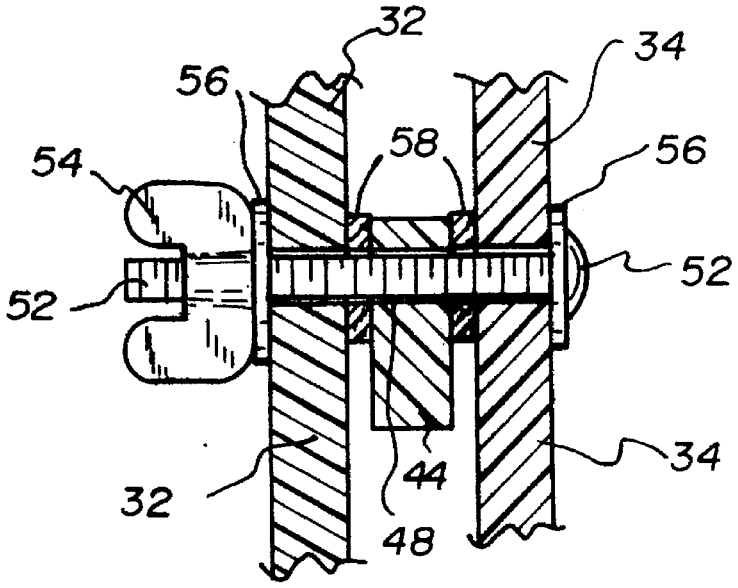
FIG. 6 is a cross sectional view taken along line 6—6 of FIG. 2.

As best illustrated in FIGS. 1 through 6, it can be shown that a first triangular-support member 32 is formed to the shape of a right-triangle with a first adjusting slot 36 paralleling the hypotenuse edge of the first triangular-support member 32. A second triangular-support member 34 is aligned parallel to the first triangular-support member 32 formed to the shape of a right-triangle with a second adjusting slot 37 paralleling the hypotenuse edge of the second triangular-support member 34. The second triangular-support member 34 further comprises an aligning slot 38 paralleling the hypotenuse edge of the second triangular-support member 34. A protective padding 42 is secured to the top of a gun support arm 44 by a protective padding fastener 46. The gun support arm 44 comprises a support arm aperture 48 near the rear end of the gun support arm 44. An adjusting bolt 52 projects through an adjusting washer 56 then projecting through the first adjusting slot 36, projecting further through a bushing 58, thereupon through the support arm aperture 48, then projecting through another bushing 58, then through the second adjusting slot 37, thereupon projecting through another adjusting washer 56, and at that point coupling with a wing nut 54 as shown in FIG. 6 of the drawings. An aligning shaft 59 is secured to the gun support arm 44 which then projects into the aligning slot 38 maintaining the gun support arm 44 parallel to the gun resting base 20.

In use, the user simply loosens the wing nut 54 and slides the gun support arm 44 to the desired position. The user then tightens the wing nut 54 securing the gun support arm 44 allowing placement of a gun upon the gun support arm 44 for shooting.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An Adjustable Gun Resting System comprising: gun resting base;

a supporting means secured to the gun resting base;

a gun holding means slidably secured to the supporting means;

an adjusting means for adjusting the height of the gun holding means; and wherein the supporting means comprises a first triangular-support member formed to the shape of a right-triangle with a first adjusting slot paralleling the hypotenuse edge of the first triangular-support member.

2. The Adjustable Gun Resting System of claim 1, wherein the supporting means further comprises a second triangular-support member aligned parallel to the first triangular-support member formed to the shape of a right-triangle with a second adjusting slot paralleling the hypotenuse edge of the second triangular-support member and wherein the second triangular-support member further comprises an aligning slot paralleling the hypotenuse edge of the second triangular-support member.

3. The Adjustable Gun Resting System of claim 2, wherein the gun holding means includes:

a gun support arm with a support arm aperture near the rear end; and a protective padding secured to the top of the gun support arm by a protective padding fastener.

4. The Adjustable Gun Resting System of claim 3, wherein the adjusting means comprises an adjusting bolt projecting through an adjusting washer, then projecting through the first adjusting slot, projecting further through a bushing, thereupon through the support arm aperture, then projecting through another bushing, then through the second adjusting slot, thereupon projecting through another adjusting washer, at that point coupling with a wing nut.

5. The Adjustable Gun Resting System of claim 4, wherein the adjusting means further comprises an aligning shaft secured to the gun support arm projecting into the aligning slot.

* * * * *